US006397530B1

(12) United States Patent
Terry et al.

(10) Patent No.: US 6,397,530 B1
(45) Date of Patent: Jun. 4, 2002

(54) SLIDING SERVICE WINDOW ASSEMBLY

(75) Inventors: Dan L. Terry; Brian K. Coble, both of Houston, TX (US)

(73) Assignee: Quikserv Corporation, Houston, TX (US)

( * ) Notice: Subject to any disclaimer, the term of this patent is extended or adjusted under 35 U.S.C. 154(b) by 0 days.

(21) Appl. No.: 09/679,019

(22) Filed: Oct. 4, 2000

(51) Int. Cl.[7] ..... E06B 1/04
(52) U.S. Cl. ..... 52/204.1; 49/213; 189/72
(58) Field of Search ..... 52/204.51; 49/455, 49/456, 457, 458

(56) References Cited

U.S. PATENT DOCUMENTS

| | | | | |
|---|---|---|---|---|
| 725,581 | A | 4/1903 | McLaughlin | |
| 1,205,435 | A | 11/1916 | Cory | |
| 1,245,709 | A | 11/1917 | Hager | |
| 1,738,792 | A | 12/1929 | O'Rourke | |
| 2,057,975 | A | * 10/1936 | Plym | 189/72 |
| 2,339,315 | A | 1/1944 | Alio | 20/19 |
| 2,878,532 | A | 3/1959 | Clark | 20/19 |
| 2,989,302 | A | 6/1961 | Clark | 268/30 |
| 3,074,124 | A | 1/1963 | Bergstedt | 20/19 |
| 3,318,048 | A | 5/1967 | Odend'hal | 49/223 |
| 3,805,450 | A | 4/1974 | Forcina | 49/231 |
| 4,250,955 | A | 2/1981 | Plattner et al. | 165/14 |
| 4,461,160 | A | 7/1984 | Van Gompel | 70/100 |
| 4,646,471 | A | 3/1987 | Shaiu | 49/231 |
| 5,165,142 | A | 11/1992 | Pilsbury | 16/90 |
| 5,572,830 | A | 11/1996 | Freeman | 49/273 |
| 5,970,657 | A | 10/1999 | Glass | 49/231 |
| 5,996,285 | A | * 12/1999 | Guillemet et al. | 49/213 |

OTHER PUBLICATIONS

"Manual Operation & Manual 'Self–Closing' Windows Single Sliders", QUIKSERV®, M.C.E. Systems Corp.

"Manual Windows Bi–Fold and Single Sliding", QUIK-SERV®, M.C.E. Systems Corp.

"Ready Access Inc. The Leader in Pass–Thru Windows Systems", Ready Access Inc.

* cited by examiner

*Primary Examiner*—Carl D. Friedman
*Assistant Examiner*—Steve Varner
(74) *Attorney, Agent, or Firm*—Trop, Pruner & Hu, P.C.

(57) ABSTRACT

A sliding service window assembly may be provided with a weight that automatically closes a window. The weight may be attached through a wire to a bracket on the top of the window so that whenever the window is released, it automatically closes. Through the use of a weight, the window closes regardless of the misorientation of the window within a building. There is no need for adjustments between the window and the frame since the inclination of the assembly is not important. In addition, because the window moves in a horizontal direction parallel to the frame, there is no misalignment between the window and the frame in the closed position which could result in air exchange.

15 Claims, 4 Drawing Sheets

SLIDING SERVICE WINDOW ASSEMBLY

BACKGROUND

This invention relates generally to sliding service windows for example that may be used by fast food restaurants.

Sliding service windows are utilized by fast food restaurants to provide food and receive money from customers in drive-thru restaurants. Sliding service windows are also used by other establishments that provide drive-thru or walk-up service for their customers. Conventionally, the window is positioned in the establishment at the level of a car window. The restaurant employee may open the window and hand out food or receive money through the window. Advantageously, the window may self-close for example for health code reasons.

Many sliding service windows are self-closing in that the windows, once opened, automatically close when the window is released by the user. Maintaining the window in a normally closed state may have health and environmental advantages.

One way to automatically close a sliding service window is to use of a so-called gravity operated window where the window is mounted on an inclined track. However, these windows tend to have a disadvantage because the window assembly may not be installed at a precisely level orientation. As a result, the window may close either too fast, too slow or not at all.

Thus, there is a need for a better way to provide an automatically closing sliding service window.

DETAILED DESCRIPTION

Figure 1:
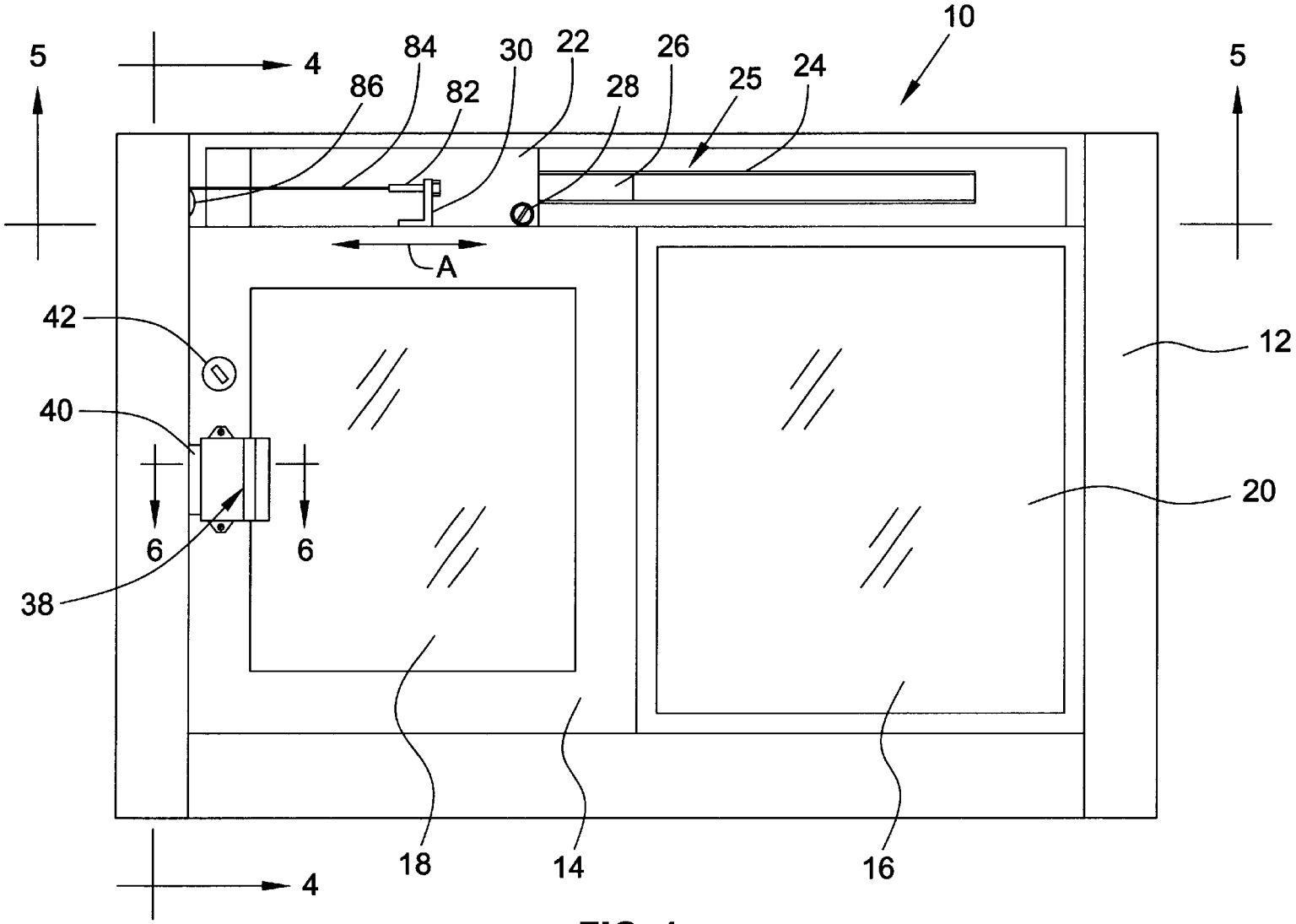
FIG. 1 is a front elevational view from the inside of a sliding service window in accordance with one embodiment of the present invention.
Figure 2:
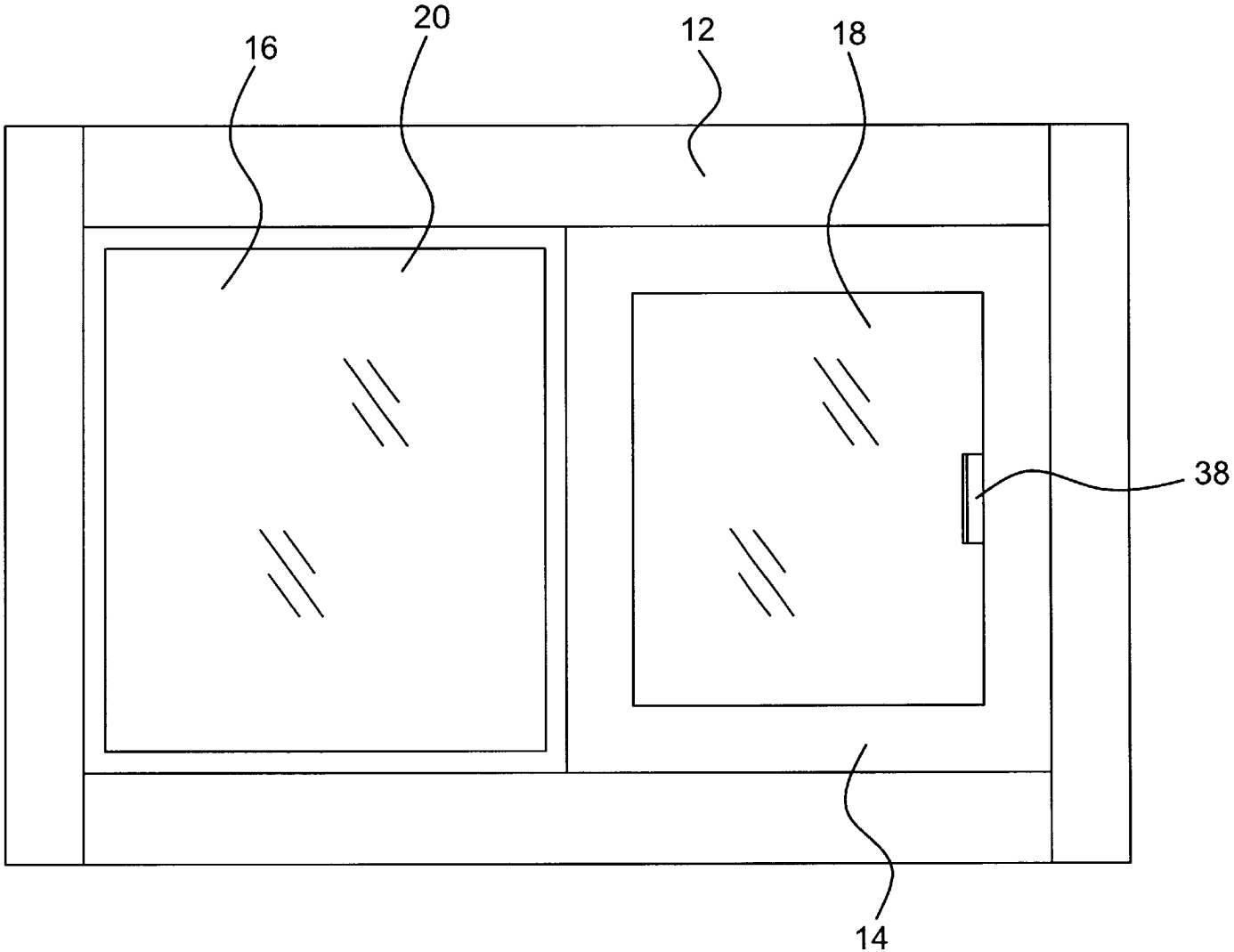
FIG. 2 is a front elevational view from the outside of the window shown in FIG. 1.

Referring to FIG. 1, a sliding service window assembly 10 may include a peripheral frame 12, a sliding window 14 and a window 16 that, in one embodiment of the present invention, may be fixed. The window 14 may include a frame and a transparent or glass central portion 18. Similarly, the window 16 may include a transparent portion A vertically upstanding plate 22 may be attached along the upper edge of the sliding window 14. The plate 22 may be mounted on a bearing or caster assembly 25 for movement of the window 14 from the position shown in FIG. 1 to the right, overlaying the window 16. Thus, the movement of the window 14 may be guided by the upstanding plate 22 and the bearing or caster assembly 25. The bearing or caster assembly 25 may include an external track 24 fixedly secured to the frame 12 and an internal race 26, secured to the window 14 by the bracket 22. The slide 26 may include a plurality of ball bearings.

Figure 3:
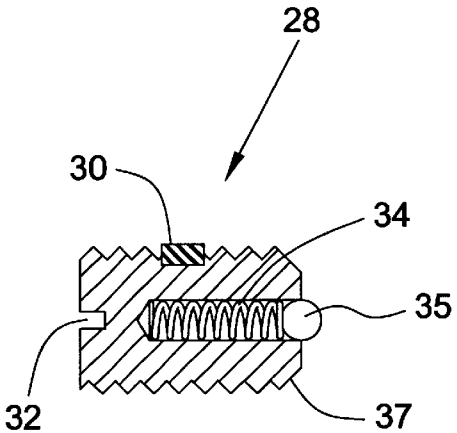
FIG. 3 is a greatly enlarged cross-sectional view through a component shown in FIG. 1 in accordance with one embodiment of the present invention.
Figure 5:
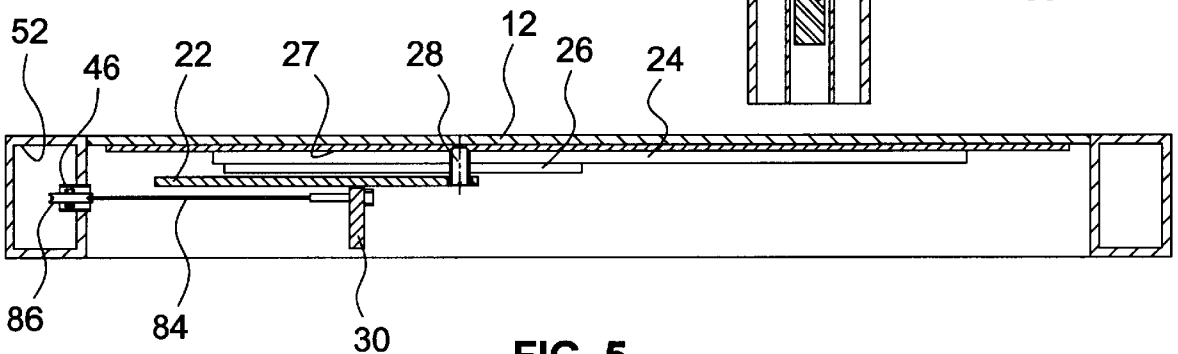
FIG. 5 is a cross-sectional view taken generally along the line 5—5 in FIG. 1.

The rate of closure of the window 14 may be controlled by an adjustment member 28. The adjustment member 28 may include a threaded body 32 that may be screwed into or out of the upstanding plate 22 as shown in FIG. 3. Within the body 32 is a spring 34 and a ball bearing 35. The external surface of the body 32 includes threads 37. The body 32 may be threadedly adjusted into the plate 22 to control the amount of force applied by the spring 34 to the bearing 35. Thus, the bearing 35 bears against the frame 12 surface 27, as shown in FIG. 5.

Also mounted on the upper edge of the window 14 is an L-shaped bracket 30 that couples to an adjustable, threaded member 82 as shown in FIG. 1. The member 82 controls the tension in a wire 84. The wire 84 extends over a roller 86, as shown in FIG. 1. Similarly, as shown in FIG. 5, the roller 86 is mounted on a pin 46 positioned over a rectangular vertical chamber 52.

Figure 4:
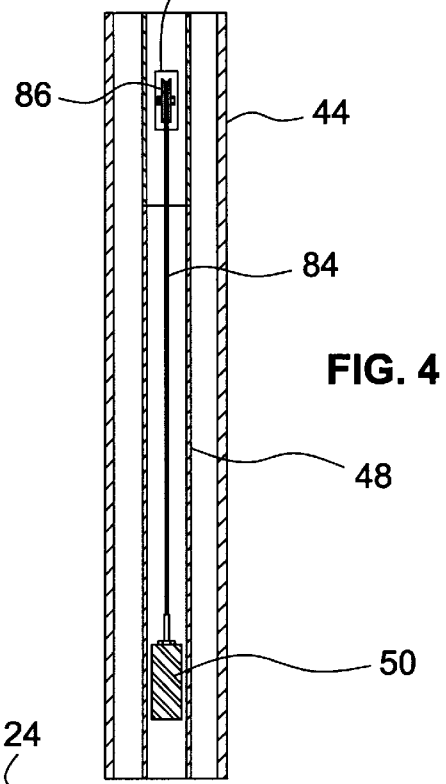
FIG. 4 is a cross-sectional view taken generally along the line 4—4 in FIG. 1.

Turning next to FIG. 4, the pulley 36 allows the wire 84 to connect to a weight 50. The weight 50 is constrained to move vertically within a tube 48 that matches the shape of the weight 50. For example, if the weight 50 is cylindrical, the tube 48 may also be cylindrical having a diameter slightly greater than the diameter of the weight 50.

As a result, the weight 50 tends to pull the window 14 closed. The window 14 slides through the interaction between the vertical plate 22 and the bearing or caster assembly 25. Thus, regardless of whether the window 10 is level, the sliding window 14 is always pulled closed by the weight 50. Because the movement of the weight 50 is guided by the tube 48, the non-level orientation of the window 10 does not adversely affect the ability of the window 14 to be pulled closed.

Figure 6B:
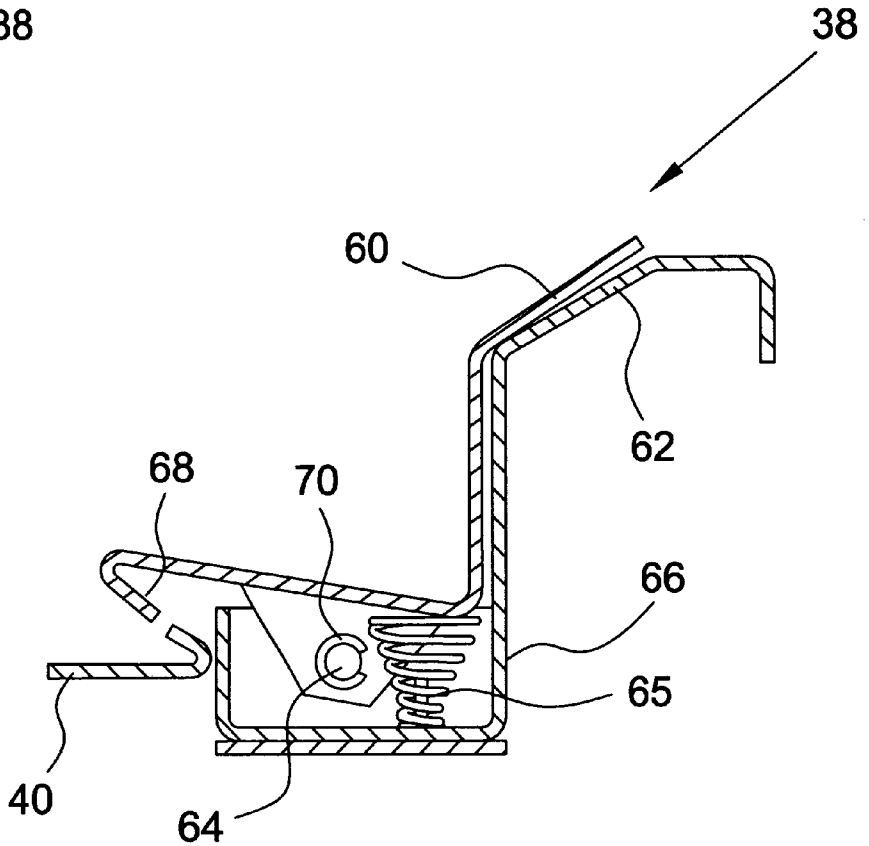
FIG. 6*b* is a cross-sectional view taken generally along the line 6—6 in FIG. 1 when a self-closing latch has been operated open.
Figure 6A:
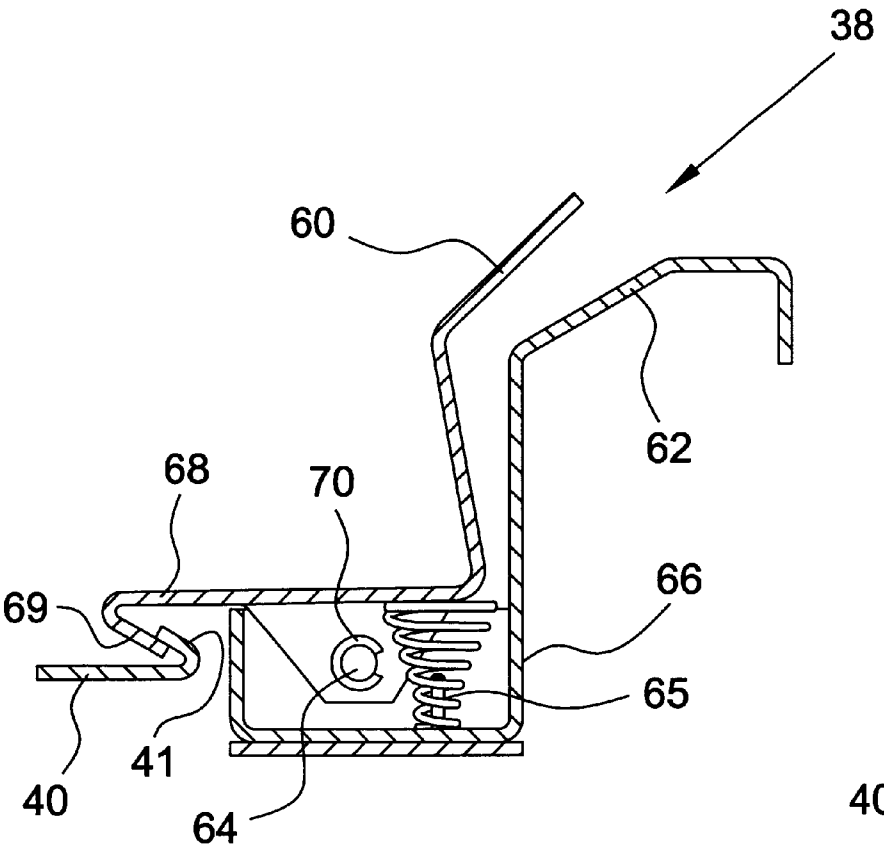
FIG. 6*a* is a greatly enlarged cross-sectional view taken generally along the line 6—6 in FIG. 1.

As shown in FIG. 6*a*, when the window 14 moves from right to left (or left to right) under action of the weight 50, the self-latching closure 38 automatically latches the window 14 closed by engaging a catch 40 coupled to the frame 12. The catch 40 may have an end 41 which is turned away from the window 14. The self-latching closure 38 automatically engages the catch 40 when the window reaches its closed position. That is, the inclined end 69 of the catch 68 is biased upwardly by the inclined, leading edge of the end 41 and as a result the catch 68 snaps over and is engaged within the catch 40. Thus, the catches 40 and 68 secure the window 14 to the frame 12.

The ability of the catch 68 to pivot upwardly when it engages the catch 41 is due to the fact that the L-shaped catch 68 is mounted for pivotal movement about a pin 64 engaged within a frame 66 secured to the window 14. The pin 64 may be held in place by an E-clip 70. Thus, when the leading edge of the catch 68 engages the catch 40, the catch 68 pivots in a clockwise direction around the pivot pin 64.

The clockwise rotation of the catch 68 is resisted by a coil spring 65 held within the frame 66. The frame 66 also includes a stop arm 62 that is arranged in juxtaposition to the arm 60 of the catch 68.

When the user desires to release the window 14, for example to move it to the open position from the position shown in FIG. 1, the user simply presses the arm 60 against the arm 62 as shown in FIG. 6*b*. This causes the catch 68 to pivot upwardly, releasing the engagement between the catches 40 and 68. This motion occurs against the bias applied by the spring 65. Thereafter, the user can push against the arms 60 and 62 to drive the window 14 to the rightmost or open position.

When the user releases the arms 60 and 62, the window 14 automatically slides to the closed position as shown in FIG. 1. This occurs due to the action applied by the weight 50 that pulls the window 14 to the closed position automatically. The rate of travel of the window 14 may be adjusted by threadedly adjusting the member 28 to introduce the desired level of drag.

As the catch 68 engages and rides over the catch 40, the catch 68 thereafter becomes engaged by the catch 40 securing the window 14 releasably in its closed position. Thereafter, for example at the end of the work day, the window may be locked shut using an appropriate lock member 42 to engage the window 14 to the frame 12.

With embodiments of the present invention, the problem of unlevelness of the assembly 10 as installed in a building may be overcome. There need be no concern, as may be case with gravity operated windows, that the window might not adequately close because the inclined mounting system for the window is offset by the inappropriately inclined orientation of the window within the building.

In addition, embodiments of the present invention avoid the need for adjustment means to enable the installer or the user to adjust the relative angulation of the window after use. Because the angulation of the window is not critical, there is no need to provide an adjustment means to adjust the orientation of the sliding window relative to the frame to cause gravity to assist in closing the inclined window.

Similarly, insulation means to prevent air from entering the building are also unneeded with embodiments of the present invention. For example, with gravity operated windows, working with an inclined track window, a gap may be left between the window and the frame. This gap results in air exchange with the exterior environment. In such case, an insulation means may be needed to close the gap and prevent air exchange past the window. By operating the window 14 in the horizontal direction indicated by the arrow A in FIG. 1, parallel to the length of the frame 12, no such gap is created.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A service window assembly comprising:

a frame;

a window mounted in said frame for a lateral sliding movement;

a weight coupled to said window to automatically close said window; and an adjustable drag device between said window and said frame.

2. The service window assembly of claim 1 wherein said drag device includes a threadedly adjustable member to vary the drag between the window and the frame.

3. The service window assembly of claim 2 wherein said drag device includes a threaded body, a bearing, and a spring captured between said threaded body and said bearing, said bearing adapted to ride on said frame such that the pressure supplied by said bearing to said frame is adjustable through said threaded member.

4. A service window assembly comprising:

a frame;

a window mounted in said frame for a lateral sliding movement, wherein said window moves in a horizontal direction parallel to the length of said frame; and a weight coupled to said window to automatically close said window.

5. The service window assembly of claim 4 including a tube formed in said frame, said weight riding within said tube.

6. The service window assembly of claim 5 wherein said tube and said weight have mating shapes.

7. The service window assembly of claim 4 wherein said window is mounted in said frame on a bearing assembly.

8. The service window assembly of claim 7 including an upstanding vertical member secured to said window, said upstanding member permanently fixed to said bearing assembly.

9. The service window assembly of claim 4 including a roller, said weight mounted in said frame for movement in a vertical direction traverse to the lateral sliding movement of said window, said pulley transforming a force applied by said weight in a vertical direction into a lateral force applied to said window.

10. A method comprising:

providing a window mountable in a frame for a lateral sliding movement;

causing said window to close automatically when released through the action of a weight coupled to said window; and controlling the amount of force applied between said window and said frame.

11. A service window assembly comprising:

a frame;

a window mounted in said frame for horizontal sliding movement; and a device to supply a vertically oriented force within said frame to cause said window to automatically close.

12. The service window assembly of claim 11 wherein said device includes a weight, a cable connected to said window and said weight, and a roller.

13. The service window assembly of claim 11 including a device to allow the force between the window and the frame to be adjusted.

14. The service window assembly of claim 13 wherein said device includes a threaded member, a ball bearing and a spring such that said threaded member can be threaded through said window to increase or decrease the amount of force applied by said spring to said ball bearing, said ball bearing adapted to ride on said frame.

15. The service window assembly of claim 11 wherein said device includes a weight that moves vertically inside said frame.

* * * * *

US006397530C1

(12) EX PARTE REEXAMINATION CERTIFICATE (5110th)

United States Patent
Terry et al.

(10) Number: US 6,397,530 C1
(45) Certificate Issued: May 10, 2005

(54) SLIDING SERVICE WINDOW ASSEMBLY

(75) Inventors: Dan L. Terry, Houston, TX (US); Brian K. Coble, Houston, TX (US)

(73) Assignee: Quikserv Corporation, Houston, TX (US)

Reexamination Request:
No. 90/006,416, Oct. 16, 2002

Reexamination Certificate for:

| | |
|---|---|
| Patent No.: | **6,397,530** |
| Issued: | **Jun. 4, 2002** |
| Appl. No.: | **09/679,019** |
| Filed: | **Oct. 4, 2000** |

(51) Int. Cl.[7] ..... E06B 1/04; E06B 3/32; E05F 3/00

(52) U.S. Cl. ..... 52/204.1; 49/445; 49/213; 49/447; 52/204.51; 16/194

(58) Field of Search ..... 52/207, 204.51, 52/656.7, 656.5; 49/445, 446, 447; 16/216, 194

(56) References Cited

U.S. PATENT DOCUMENTS

| | | | | | |
|---|---|---|---|---|---|
| 481,103 | A | * | 8/1892 | Cayce | 49/447 |
| 1,076,753 | A | * | 10/1913 | Doyle | 49/447 |
| 1,820,947 | A | * | 9/1931 | Plym | 49/458 |
| 2,085,832 | A | * | 7/1937 | Shochet | 312/139.2 |
| 2,953,824 | A | * | 9/1960 | Minick | 52/207 |
| 3,057,023 | A | * | 10/1962 | Hewit | 52/204.51 |
| 3,328,105 | A | * | 6/1967 | Trulaske | 49/445 |
| 3,334,444 | A | | 8/1967 | Hargrove | |
| 4,003,102 | A | | 1/1977 | Hawks et al. | |
| 4,763,446 | A | * | 8/1988 | Kelly | 49/407 |
| 4,891,911 | A | | 1/1990 | Yung | |
| 5,285,596 | A | | 2/1994 | Kinsey | |
| 6,065,184 | A | | 5/2000 | Drury | |

* cited by examiner

*Primary Examiner*—Brian E. Glessner

(57) ABSTRACT

A sliding service window assembly may be provided with a weight that automatically closes a window. The weight may be attached through a wire to a bracket on the top of the window so that whenever the window is released, it automatically closes. Through the use of a weight, the window closes regardless of the misorientation of the window within a building. There is no need for adjustments between the window and the frame since the inclination of the assembly is not important. In addition, because the window moves in a horizontal direction parallel to the frame, there is no misalignment between the window and the frame in the closed position which could result in air exchange.

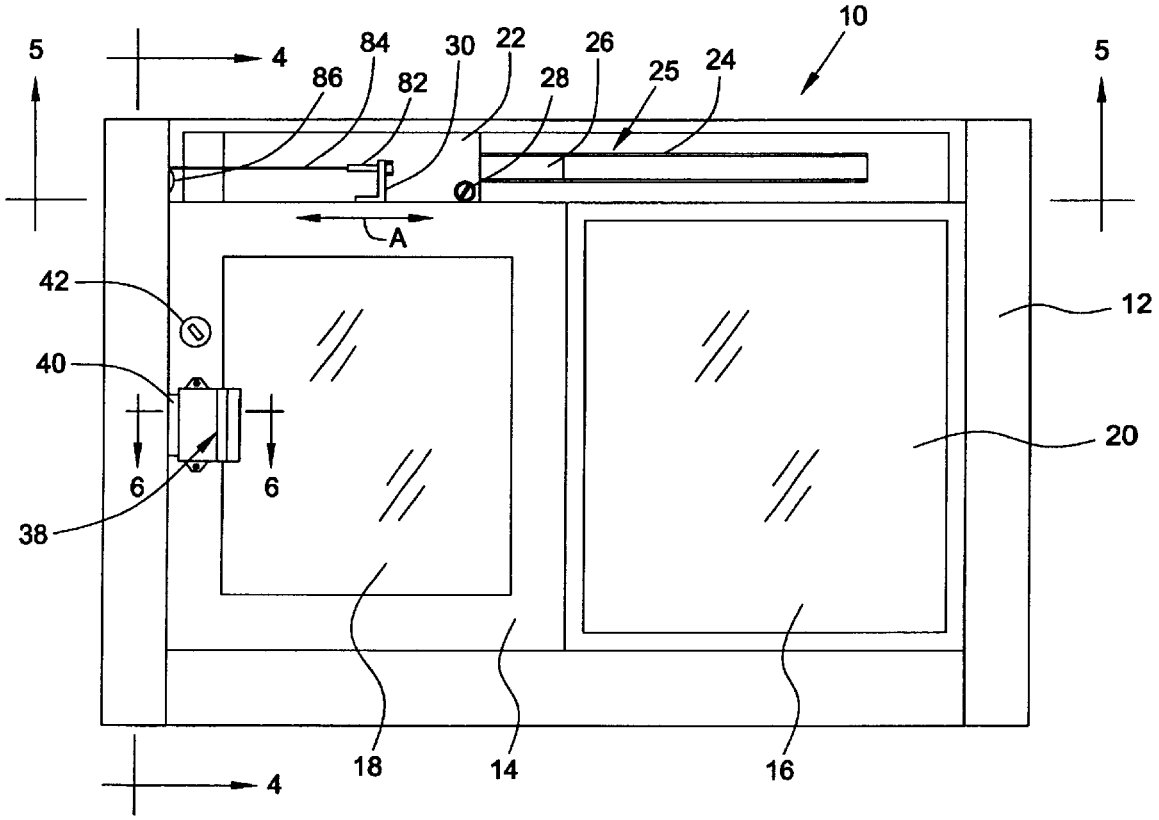

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–3, 8, 10, 13 and 14 is confirmed.

Claims 4–7, 9, 11, 12 and 15 are cancelled.

New claims 16–25 are added and determined to be patentable.

*16. A service window assembly comprising:*

*a peripheral frame including two vertically oriented side panels, a top horizontally oriented panel and a bottom horizontally oriented panel, said side panels, said top panel and said bottom panel connected to define an opening for a sliding service window, at least one of said vertically oriented panels having four sides that are coupled to form a chamber;*

*a fixed window mounted in said peripheral frame;*

*a movable window including a transparent portion, two side members, a top member and a bottom member, said movable window mounted in said peripheral frame and adapted to slide horizontally to overlay said fixed window such that an opening sized for drive-thru transactions is created when said movable window is in an open position overlying said fixed window;*

*a weight disposed in said chamber and coupled to said movable window, said weight to provide a vertically oriented force to automatically close said movable window when released from said open position; and*

*said movable window is coupled to said top horizontally oriented panel, said coupling adapted to facilitate the horizontal slidable movement of said movable window.*

*17. The service window assembly of claim 16 wherein said weight is coupled to said window by a cable, said cable being within said chamber and between said two vertically oriented panels, parallel to one of said horizontally oriented panels.*

*18. The service window assembly of claim 17 further including a bracket to couple said cable to an uppermost surface of the top member of said movable window.*

*19. The service window assembly of claim 18 further including a roller mounted on a pin and positioned over said chamber, said roller to guide said cable such that the vertically oriented force provided by said weight is translated to a lateral force applied to said movable window.*

*20. A service window assembly comprising:*

*a first and second side member, at least one of said side members adapted to have a hollow center;*

*a top member disposed between said first and second side members, said top member having a front surface and a back surface;*

*a bottom member disposed between said first and second side members, parallel to said top member, said bottom member, said top member, and said first and second side members coupled to form a peripheral frame that defines at least part of a space for drive-through transactions to occur through;*

*a slidable window mounted in said peripheral frame, said slidable window including a transparent sheet and a window frame, wherein an uppermost surface of said window frame is coupled to the back surface of said top member to enable horizontal sliding movement; and*

*a weight coupled to said window frame, said weight movable in said hollow center of said side member, said weight to supply a vertically oriented force to automatically close said slidable window.*

*21. The service window assembly of claim 20 wherein said top member is coupled to said side member having the hollow center such that said hollow center is accessible at the coupling point.*

*22. The service window assembly of claim 21 further including a roller positioned at the coupling point, over said side member adapted to have the hollow center.*

*23. The service window assembly of claim 22 further including a cable extending over said roller to couple said window frame to said weight, said cable being entirely within said peripheral frame.*

*24. The service window assembly of claim 23 wherein said cable is coupled to the uppermost surface of said window frame.*

*25. The service window assembly of claim 20 further including a fixed window mounted in said peripheral frame, said slidable window to overlay said fixed window to expose the space for drive-thru transactions.*

* * * * *